US008465007B2

(12) United States Patent
Coffield et al.

(10) Patent No.: US 8,465,007 B2
(45) Date of Patent: Jun. 18, 2013

(54) LOAD BEARING ASSEMBLY WITH ELASTOMERIC EDGE

(75) Inventors: Timothy P. Coffield, Grand Rapids, MI (US); Mark A. Carrier, Newaygo, MI (US)

(73) Assignee: Illinois Tool Works Inc., Glenview, IL (US)

( * ) Notice: Subject to any disclaimer, the term of this patent is extended or adjusted under 35 U.S.C. 154(b) by 890 days.

(21) Appl. No.: 11/641,260

(22) Filed: Dec. 19, 2006

(65) Prior Publication Data

US 2007/0221814 A1 Sep. 27, 2007

Related U.S. Application Data

(60) Provisional application No. 60/784,840, filed on Mar. 22, 2006.

(51) Int. Cl.
*A47C 23/00* (2006.01)
*A47C 27/00* (2006.01)

(52) U.S. Cl.
USPC ..... 267/142; 267/143; 297/452.15

(58) Field of Classification Search
USPC ..... 267/142–146; 297/452.12–452.15, 297/218.2, 218.3; D6/500, 596
See application file for complete search history.

(56) References Cited

U.S. PATENT DOCUMENTS

| | | | | | |
|---|---|---|---|---|---|
| 3,175,269 | A | * | 3/1965 | Raduns et al. | 24/265 C |
| 3,498,668 | A | * | 3/1970 | Vanderminden | 297/45 |
| 3,770,235 | A | * | 11/1973 | Klapproth et al. | 248/634 |
| 4,370,293 | A | * | 1/1983 | Petersen-Hoj | 264/514 |
| 4,435,882 | A | * | 3/1984 | Unger | 24/265 R |
| 4,558,904 | A | * | 12/1985 | Schultz | 297/440.11 |
| 4,861,104 | A | * | 8/1989 | Malak | 297/218.3 |
| 5,049,347 | A | | 9/1991 | Magill et al. | 264/280 |
| 5,472,154 | A | * | 12/1995 | Qiu et al. | 242/609.4 |
| 5,863,467 | A | * | 1/1999 | Mariner et al. | 252/511 |
| 6,106,752 | A | * | 8/2000 | Chang et al. | 264/108 |
| 6,152,534 | A | * | 11/2000 | Maeda et al. | 297/452.56 |
| 6,360,522 | B1 | * | 3/2002 | Walton | 57/212 |
| 6,375,269 | B1 | | 4/2002 | Maeda et al. | 297/452.56 |
| 2003/0160494 | A1 | * | 8/2003 | Coffield | 297/440.11 |
| 2005/0206210 | A1 | | 9/2005 | Coffield | |
| 2005/0279591 | A1 | | 12/2005 | Coffield et al. | |
| 2006/0267258 | A1 | | 11/2006 | Coffield et al. | |

FOREIGN PATENT DOCUMENTS

| | | |
|---|---|---|
| EP | 1048246 | 11/2000 |
| EP | 1607028 | 12/2005 |

* cited by examiner

*Primary Examiner* — Melody Burch
(74) *Attorney, Agent, or Firm* — Levenfeld Pearlstein, LLC

(57) ABSTRACT

A load bearing assembly includes a molded plastic retainer that supports a load bearing surface over an opening defined by a frame. The molded plastic retainer includes a first portion attached to the frame, a second portion attached to the load bearing surface, and at least one elastic connector integrally molded with the retainer. The elastic connector is oriented such that it includes a crystalline structure having a greater degree of alignment in one direction than in other directions.

16 Claims, 6 Drawing Sheets

LOAD BEARING ASSEMBLY WITH ELASTOMERIC EDGE

This application claims the benefit of U.S. Provisional Patent Application No. 60/784,840, filed Mar. 22, 2006.

BACKGROUND OF THE INVENTION

The present invention relates to load bearing assemblies, and more particularly to load bearing assemblies for supporting a load bearing surface over an opening with a peripheral frame, such as the seat or back of a chair or bench, or the support surface of a bed, cot or other similar product.

There are continuing efforts to develop new and improved load bearing assemblies. In general, the primary objectives of these efforts are to obtain a durable and inexpensive load bearing surface that is relatively easy to manufacture. In the context of seating and other body-support applications, it is also important to address comfort issues. For example, with seating, it can be important to provide a surface that is comfortable and does not create body fatigue over periods of extended use. Given that the load characteristics (e.g. stiffness, resiliency, force/deflection profile) desired in a particular surface will vary from application to application, it is also desirable to have a load bearing surface that is easily tunable for different applications during design and manufacture.

It is well known to provide load bearing assemblies that include a load bearing surface supported by a frame over an opening. In some applications, such as lounge chairs, a plastic surface is supported over the opening. These surfaces can be durable and inexpensive, but suffer from drawbacks, because thicker plastic materials are rigid and uncomfortable, and thinner plastic surfaces, such as membranes or woven plastic fibers tend to permanently deform (or creep) over time.

More recently, there has been an increasing use of elastomeric fabrics as load bearing surfaces, especially in the seating industry. Elastomeric fabrics can provide a comfortable, ventilated seating structure, and can be tuned to provide a desired amount of elasticity in a particular location. Elastomeric fabrics are typically manufactured from a complex weave of high tech elastomeric monofilaments and multifilament yarns, and often require expensive machinery to stretch and attach the fabrics to a frame. The process results in a relatively expensive surface and, as a result, elastomeric fabrics are not ideal for all applications.

Accordingly, there remains a need for a load bearing assembly that is relatively inexpensive to manufacture while providing a load bearing surface that is both comfortable and durable.

SUMMARY OF THE INVENTION

In one embodiment, the present invention provides a molded plastic retainer that supports a load bearing surface over an opening defined by a frame. The molded plastic retainer includes a first portion attached to the frame, a second portion attached to the load bearing surface, and at least one elastic connector integrally molded with the retainer. The elastic connector is oriented such that it includes a crystalline structure having a greater degree of alignment in one direction than in other directions.

In another embodiment, the first portion of the molded plastic retainer extends around the periphery of the load bearing surface, and is molded to encapsulate the peripheral edge of the load bearing surface. The second portion of the molded plastic retainer is molded to include a plurality of openings on opposite sides of the load bearing surface. The openings receive prongs that extend from the frame for holding the load bearing surface in tension over the opening.

In yet another embodiment, the elastic connectors are oriented by stretching or elongating the connectors, for instance, by pulling on the ends of each connector or by compressing each connector between a pair of dies in a direction 90 degrees from the direction of orientation, such that the elastic connectors are elongated in the direction of orientation.

The present invention also provides a method for manufacturing a load bearing assembly, including the steps of: a) providing a frame that defines an opening; b) providing a load bearing surface extending over the opening; c) attaching an edge of the load bearing surface to a first portion of a molded plastic retainer; d) orienting a second portion of the molded plastic retainer by aligning the crystalline structure of the second portion to a greater degree in one direction than in other directions; and e) attaching a third portion of the molded plastic retainer to the frame such that the load bearing surface is supported over the opening.

The present invention provides a durable, yet flexible load bearing surface. The plastic retainer can be inexpensively manufactured, and easily attached to the load bearing surface and the frame while enabling the use of a wide variety of load bearing surface materials. For instance, the elasticity of the plastic retainer enables the use of relatively inexpensive, non-elastic fabrics as a load bearing surface. Further, by increasing the alignment of the crystalline structure of the integrally molded elastomeric connectors, the level of creep in the connectors can be dramatically reduced, thereby increasing the durability of the assembly.

These and other objects, advantages, and features of the invention will be readily understood and appreciated by reference to the detailed description of the preferred embodiment and the drawings.

DETAILED DESCRIPTION OF THE CURRENT EMBODIMENTS

Figure 1:
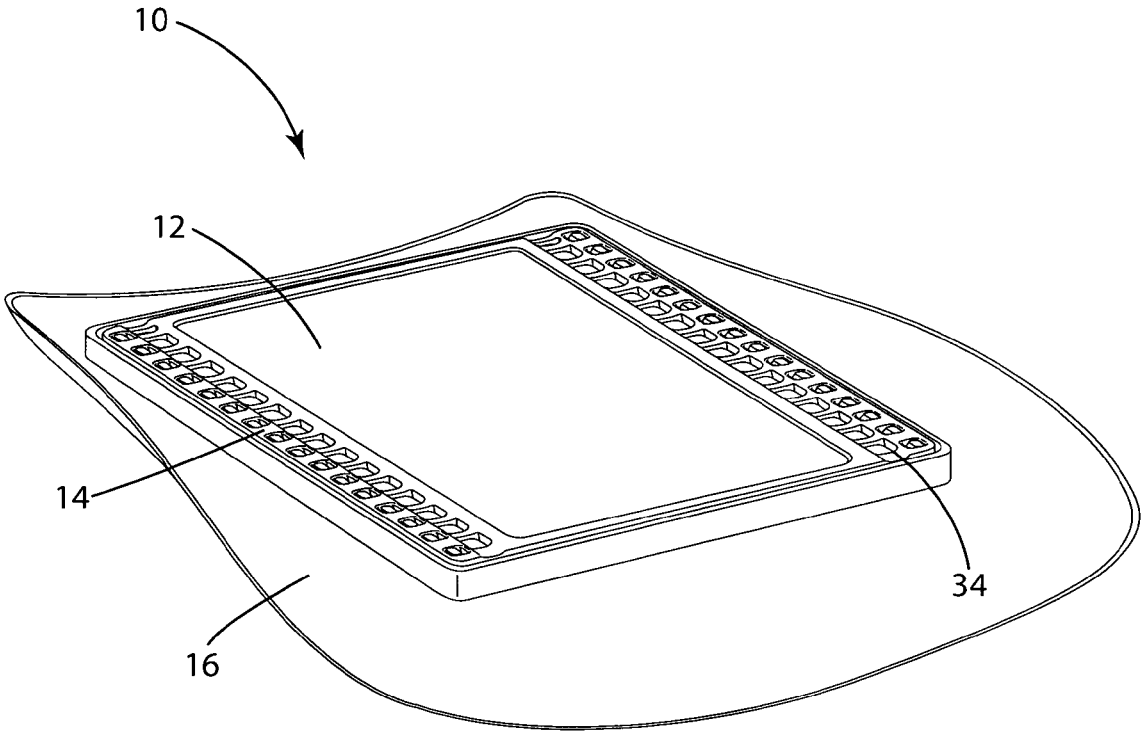
FIG. 1 is a perspective view of a load bearing assembly according to one embodiment of the present invention.

A load bearing assembly 10 according to one embodiment of the present invention is shown in FIG. 1. The assembly 10 includes a load bearing surface 12 and a molded plastic retainer 14. The molded plastic retainer attaches to the load bearing surface to support the load bearing surface on a frame 16 that defines an opening 18. For purposes of illustration, the frame is depicted as a chair seat frame; however, the frame may be used for a variety of applications. The frame 16 may extend around the entire opening, or only a portion of the opening, such as a U-shaped frame.

In one embodiment, the load bearing surface 12 is a woven, non-elastic fabric, having a periphery 20. Alternatively, the load bearing surface may be another type of fabric, such as an elastomeric fabric comprised of elastomeric monofilaments, or a material other than a fabric, such as a plastic membrane, woven plastic fibers, or another synthetic or natural material.

The retainer 14 shown in FIG. 1 is an integrally molded plastic part that attaches to the load bearing surface 12 and to the frame 16 to suspend the load bearing surface over the opening 18 defined by the frame 16. In one embodiment, the retainer 14 is molded from a thermoplastic polyether ester elastomer block copolymer. Suitable materials of this type include that available from DuPont under the Hytrel® trademark, that available from DSM under the Arnitel® trademark. The material may also be a urethane based TPU, or variety of alternative elastomers that may be suitable for use in the present invention.

Figure 2:
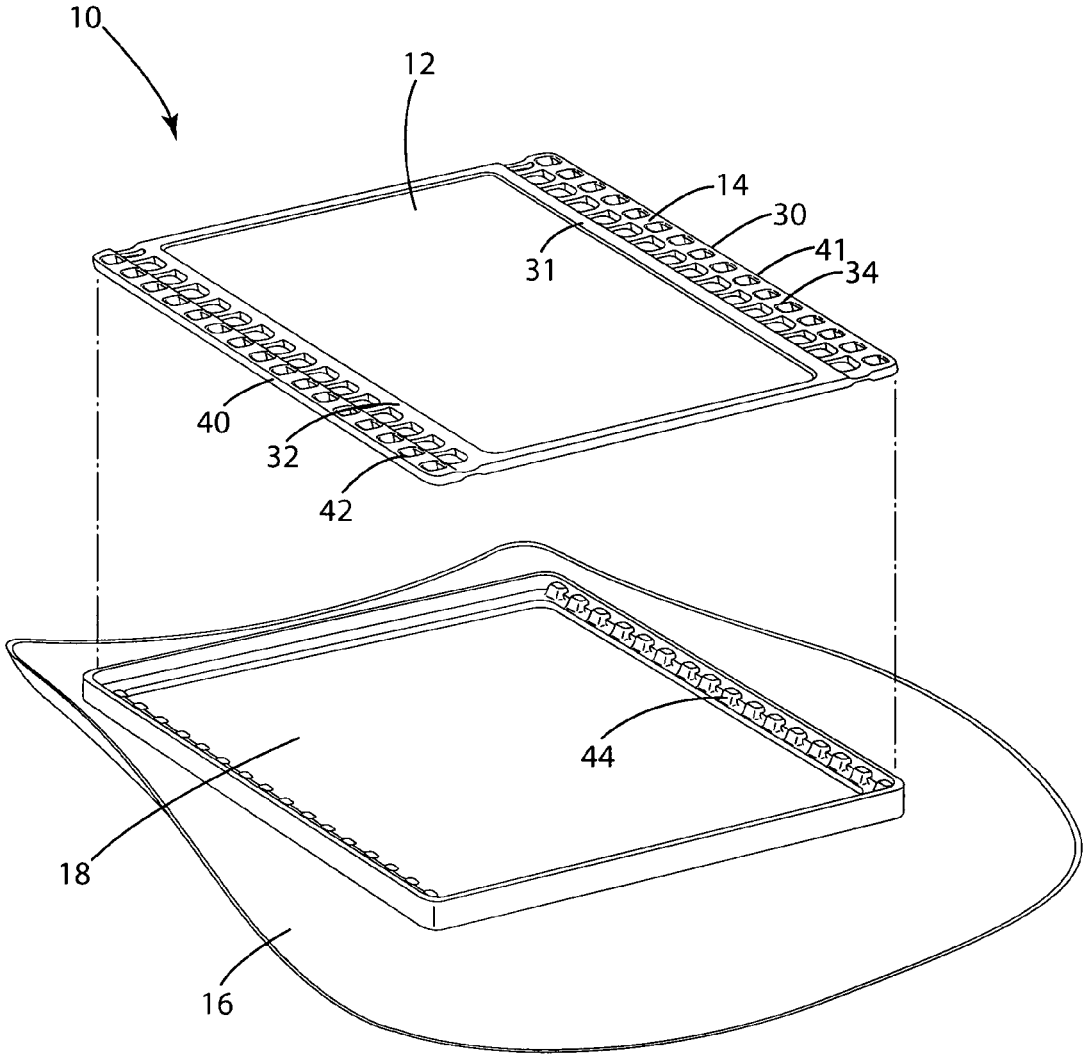
FIG. 2 is an exploded view of a load bearing assembly according to one embodiment.
Figure 3:
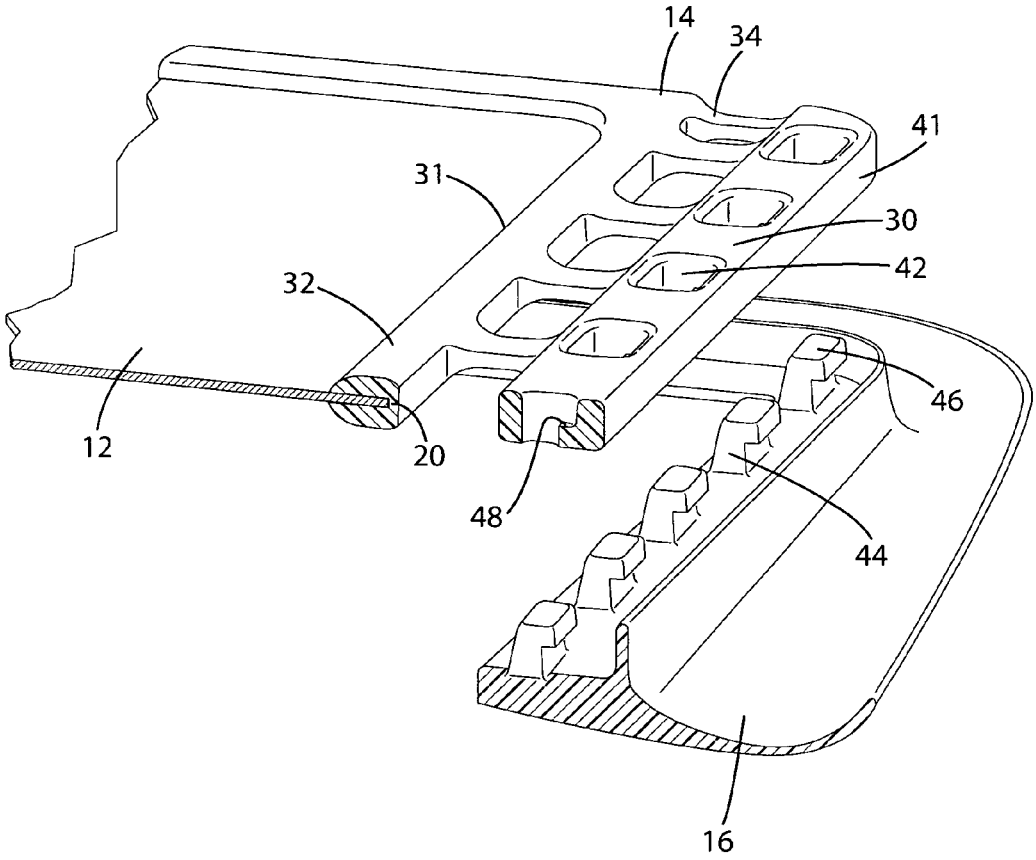
FIG. 3 is a close-up exploded view of a portion of the load bearing assembly according to one embodiment.
Figure 4:
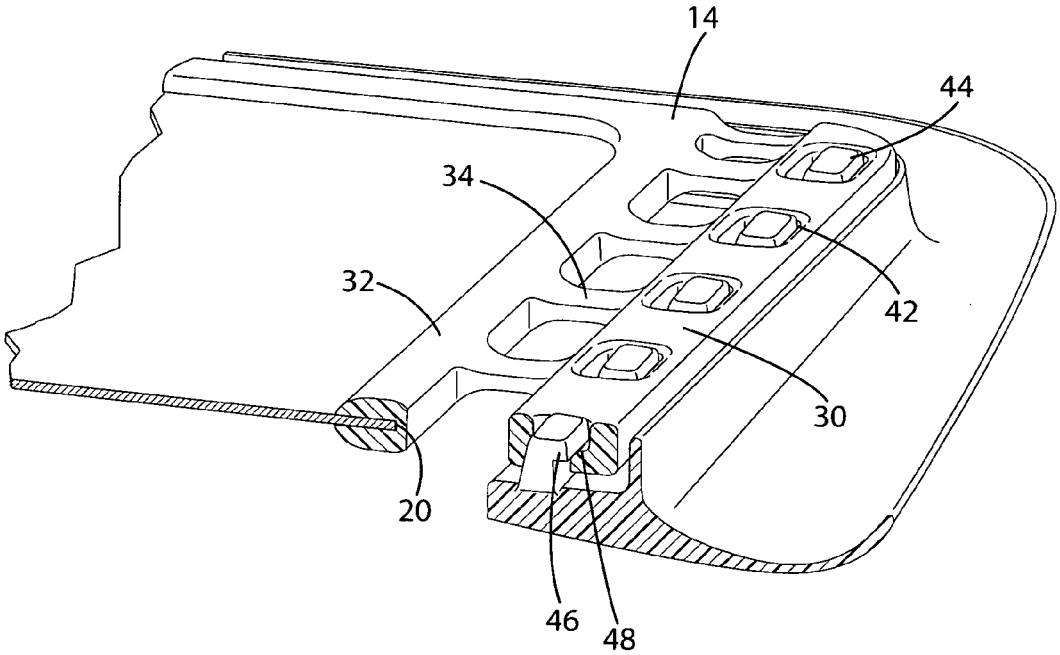
FIG. 4 is a close-up view of a portion of the load bearing assembly according to one embodiment.

Referring to FIGS. 2-4, in the illustrated embodiment, the molded plastic retainer 14 includes a first portion 30 that attaches to the frame 16, a second portion 32 that attaches to the load bearing surface 12, and a plurality of elastic connectors 34 that extend between the first portion 30 and the second portion 32. As shown, the first portion 30 forms a strip 31 that extends around the peripheral edge 20 of the load bearing surface and is molded to encapsulate the peripheral edge 20 of the load bearing surface 12. Alternatively, the first portion 30 may be attached to only a portion of the load bearing surface 12, and it may be attached by another method, such as a plurality of fasteners that extend through the molded plastic retainer 14 and the load bearing surface 12. The first portion may otherwise be molded about a portion of the load bearing surface 12 inward of the periphery 20, for instance, with the load bearing surface extending completely through the first portion 30 of the retainer 14.

The second portion 32 of the molded plastic retainer 14 enables the attachment of the retainer 14 to the frame 16. In the illustrated embodiment, the second portion is molded integrally with the retainer 14 into a pair of strips 40, 41 that extend along opposing sides of the retainer 14. Each strip 40, 41 includes a plurality of openings or slots 42 that are approximately evenly spaced apart. As shown in FIGS. 3 and 4, the openings 42 are designed to be snap-fit onto a plurality of prongs 44 that extend upwardly from the frame 16 on opposite sides of the frame 16. As shown, the prongs 44 each include a barb 46. In one embodiment, the openings 42 each include an internal ledge 48 for retaining a barb 46. In an alternative embodiment, the second portion 30 may attach only a portion of the load bearing surface to the frame 16, for instance, the second portion 30 may extend along only one edge of the load bearing surface 12 such that other portions of the load bearing surface 12 are attached directly to the frame, or with alternative connectors. In another alternative embodiment, the second portion 32 may attach to the frame by other conventional means, such as a plurality of fasteners that extend through the frame 16 and the second portion 32.

The first portion 30 and the second portion 32 are connected by at least one elastic connector, and, in the illustrated embodiment, by a plurality of elastic connectors 34. In one embodiment, the elastic connectors 34 are molded integrally with the retainer 14, and are approximately evenly spaced along opposite sides of the retainer, extending between the strip 31 of the first portion 30 and the strips 40, 41 of the second portion 32. In one embodiment, the elastic connectors are oriented in one direction (i.e. the x direction) to provide creep resistance and elasticity in the direction of orientation. The retainer 14 is oriented by increasing the alignment of the crystalline structure of the elastomeric connector on a molecular level so that its support and other load bearing characteristics are altered. More particularly, a molded, unoriented elastomeric connector is typically comprised of a plurality of spherulites, which are created during the growth of the polymer by the formation of crystalline lamellae in helical strands radiating from a nucleation point. In an oriented connector, at least some of the spherulites are destroyed and the crystalline lamellae are aligned in one direction. Typically, the connectors 34 will be oriented to such a degree that the oriented connectors 34 have materially different load bearing characteristics in the oriented direction than in other directions.

One method for orienting the connectors 34 is through stretching or elongating the connectors 34 by pulling on the ends of the connectors 34 or other portions of the retainer 14. The amount of stretch required to obtain the desired alignment will vary from application to application, but in most applications the desired degree of alignment will occur when the connectors 34 are stretched to more than two times their original dimension. In one embodiment, the connectors 34 are stretched beyond their elastic limit to a distance between approximately 4 to 8 times their original dimension, for instance, by pulling the ends of the connectors 34 using approximately 1830 lbs. of force. Because the connectors 34 are stretched beyond their elastic limit, they recover to an intermediate dimension that is deformed from its original length. This deformation is non-recoverable, permanent deformation. As a result of this orientation and non-recoverable deformation, a degree of permanent deformation is removed from the oriented connectors such that when subsequent stresses on the oriented connectors within the desired normal operating load are applied (for example in the range of approximately 100-300 lbs. for a seating application), the connectors resist permanent deformation over time (i.e. creep).

A number of parameters may be controlled to provide the connectors 34 with a desired amount of orientation. For instance, in one embodiment, the molded connectors 34 are stretched within a short time, such as 10-15 minutes, after the molded retainer 14 is removed from the mold, so that the connectors 34 are still warm when it is stretched. This reduces the force that is necessary to stretch and therefore orient the connectors 34. In another embodiment, the connectors 34 are stretched at a rate of about 1 inch per second, until they have reached the desired deformation. A slow, controlled stretch aids in maintaining a uniform orientation across each connector 34. In another embodiment, a cyclic orientation may be performed, wherein the connectors 34 are oriented by stretching them to a first distance, then relaxed to a second, intermediate distance, and then stretched to a second distance greater than the first. The sequence may be repeated as many times as necessary to achieve the desired orientation. In one specific embodiment, the connectors 34 are stretched to 2 times their original length, relaxed to 1.5 times their original length, then stretched to 3 times their original length. A cyclic orientation process helps compensate for any irregularities within the connector's material to provide a uniform stretch, because areas of greater or lesser stretch will even out after multiple cycles.

In addition to reducing creep, the stretching of the molded connectors 34 may be utilized to control the stiffness of the connectors 34, and, ultimately, the comfort level of the load bearing surface 12. First, as noted above, orienting the connectors 34 in one direction provides an increase in elasticity in the material in that direction. The increased elasticity decreases the stiffness of the material in the oriented direction, and therefore affects the comfort of the material in locations of orientation. Second, as noted above, in use, the retainer 14 is used to suspend the load bearing surface 12 from a chair seat frame. Typically, the load bearing surface 12 is supported in tension on the frame with a desired amount of pre-load. Variations in the pre-load change the stiffness of the connectors 34, and therefore affect the comfort level of the load bearing surface 12 that is supported by the retainer 14.

Figure 5:
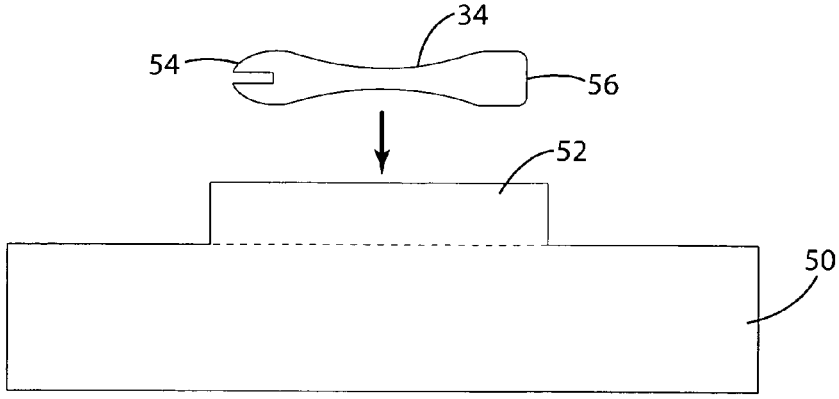
FIG. 5 is a side plan view of a molded plastic retainer and a lower compression die.
Figure 6:
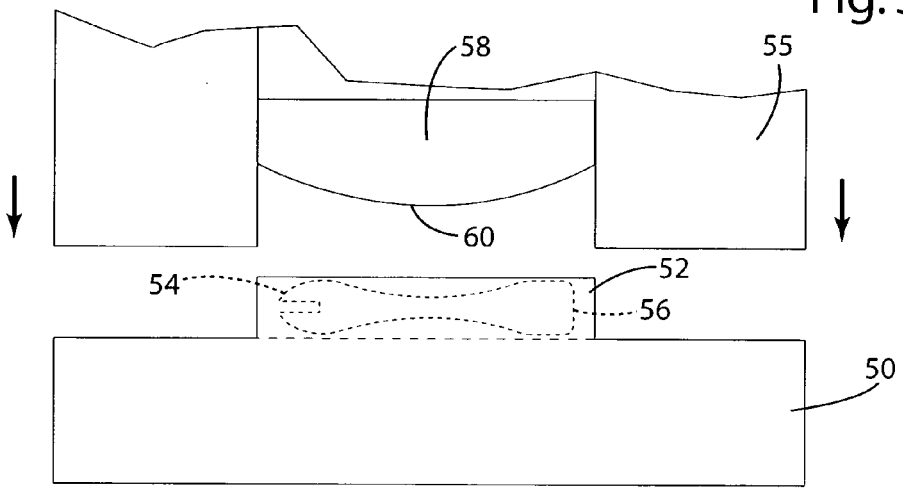
FIG. 6 is a side plan view of a molded plastic retainer and upper and lower compression dies.
Figure 7:
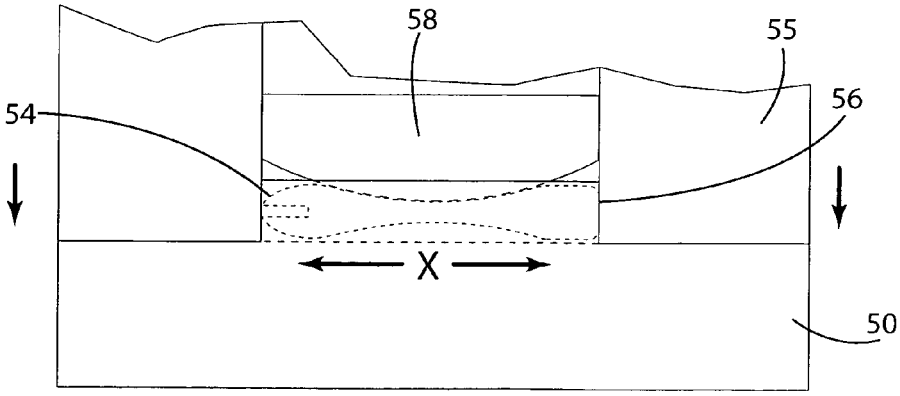
FIG. 7 is a side plan view of a molded plastic container and upper and lower dies that are closed on the retainer.
Figure 8:
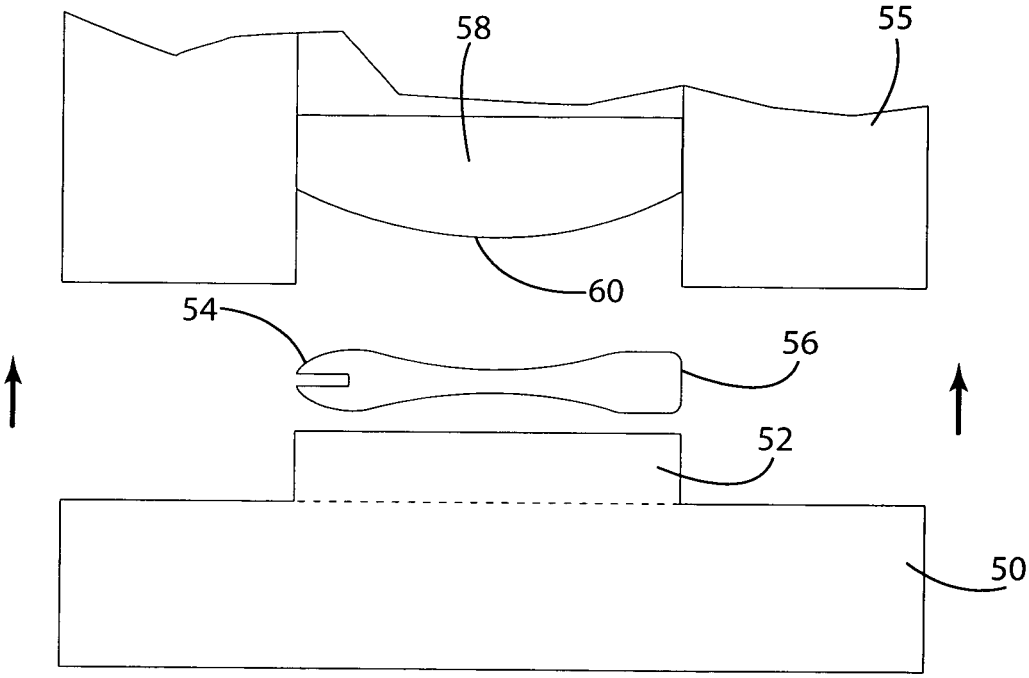
FIG. 8 is a side plan view of an oriented molded plastic container and upper and lower dies.

As an alternative to stretching the connectors 34 by pulling them in tension, the connectors 34 may be stretched by compression. In one embodiment for orienting by compression, shown in FIGS. 5-8, one or more connectors 34 are placed in a bottom die 50 or other structure that constrains the connector 34 on all sides other than at least one side that corresponds with the desired direction of orientation. As shown, the bottom die 50 includes a pair of side rails 52 for constraining the connector 34 in two directions. The opposed sides 54, 56 of the connector 34 in the unconstrained direction permit the material of the connector 34 to flow from both sides along the direction of orientation (e.g. the x-direction shown in FIG. 7). Alternatively, only a single side may be unconstrained, thereby limiting material flow to a single side. A compressive force is then applied to the connector 34. For example, as shown in FIGS. 5-7, a press 55 can be lowered to compress the connector 34 between the bottom die 50 and an upper die 58. Sufficient compressive force is applied so that the material begins to flow in the unconstrained direction. This in effect causes the connector 34 to extend or stretch and its crystalline structure to become increasingly aligned in the direction of orientation. The amount of force applied to the connector 34 may vary from application to application depending on the desired degree of alignment or orientation. The amount of force applied to the connector 34 may also be varied by changing the shape of one of the dies 50, 58. As shown, the upper die 58 includes a rounded surface 60, which reduces the amount of force needed to compress the connector 34 by gradually introducing material flow in the direction of orientation.

Although described in connection with orientation of all the elastic connectors 34, in some applications it is not necessary to orient some of the connectors 34. Rather, in some applications, it may be desirable to orient only select connectors 34 in particular locations on the retainer 14. For example, in some applications it may be desirable to orient only the central connectors of the retainer 14. In other applications, selected connectors 34 may be molded with a reduced thickness, such that primarily these selected connectors 34 will stretch and become oriented during the orientation process.

Although the connectors 34 may be oriented by stretching the connectors, it may be possible in some applications to orient the connectors 34 using other processes. For example, it may be possible to orient certain materials by hammering or other forms of compression, rather than stretching or elongating the connectors. It should be noted that many elastomeric materials, including molded Hytrel®, have essentially no elasticity and are susceptible to a high degree of creep when in a molded form. As noted above, the orientation process of the present invention causes a significant change in the properties of the elastomeric material. For example, orientation of the connectors increases the elasticity of the material and decreases its inherent susceptibility to creep.

The plastic retainer 14 is molded using conventional techniques and apparatus. For example, the plastic retainer 14 may be injection molded using a conventional injection molding apparatus (not shown) having a die that is configured to provide a retainer with the desired shape and features. In this embodiment, the plastic retainer 14 is manufactured by injecting the desired material into the die cavity. The die is designed to provide a molded blank that will take on the desired shape once any desired orientation has taken place. For example, the dies are configured to form a part that will have the desired shape of the first portion 30, second portion 32 and connectors 34. The die may include a cutout for placing the load bearing surface 12 in the die such that the first portion 30 of the retainer 14 can be molded about portions of the load bearing surface 12.

After the retainer 14 is molded, it may be stretched or otherwise oriented in one direction. If orientation is achieved through stretching or elongating, the precise amount of stretch to be applied to a connector or connectors 34 will depend on the configuration retainer 14 and load bearing surface 12 and the desired support characteristics. As a result of the plastic deformation, and the increase in alignment of the crystalline structure, the oriented connectors 34 will not fully return to their original length after being oriented. Once any desired orientation has taken place, the second portion 32 of the retainer 34 can be mounted directly to the frame 16. In one embodiment, the retainer 14 is mounted to the frame 16 by snapping the openings 42 over prongs 44 on the frame. In doing so, the retainer 14 may be stretched by hand or by machine to a desired pre-load to hold the load bearing surface 12 in tension over the opening 18.

In the illustrations, the present invention includes a plurality of connectors 34 extending between strips 30 and 40, 41. The strips 30 and 40, 41 bridge a plurality of connectors 34 and therefore provide some degree of interdependence between the connectors 34. Alternatively, the present invention may include one or more separate connector assemblies (not shown). For example, rather than having a plurality of connectors attached between strips, each connector assembly may include a connector having its own separate first portion for attaching only that connector to the frame and its own separate second portion for attaching only that connector to the load bearing surface. Because adjacent connectors are not bridged by strips, this alternative may, among other things, provide a greater degree of independence between the connectors.

In various embodiments, the elastomeric connectors may be oriented in one direction to reduce creep and provide the connectors with a desired level of elasticity in the direction of orientation. It is not, however, necessary to orient the connectors in all applications. Rather, in applications where the elasticity and creep resistance provided by orientation are not necessary (or not desirable), variation in the support characteristics of the connectors in different directions may be achieved solely by variations in the structure of the connectors.

The above description is that of various embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A load bearing assembly comprising:

a frame defining a frame opening;

a load bearing surface extending over at least a portion of said frame opening, the load bearing surface having an edge; and an injection molded plastic retainer supporting said load bearing surface over at least a portion of said frame opening, said injection molded plastic retainer including a first portion attached to said frame, a second portion attached to said load bearing surface, said second portion encapsulating the edge of said load bearing surface, and at least one elastic connector integrally molded with said retainer, at least one said elastic connector of said plurality of elastic connectors being oriented on a molecular level such that it includes a crystalline structure having a greater degree of alignment in one direction than in other directions, wherein said first portion of said molded plastic retainer defines a plurality of frame attachment openings molded into said retainer, said frame attachment openings each capable of receiving a portion of said frame for attaching said retainer to said frame, and wherein said second portion of said molded plastic retainer is molded to encapsulate a peripheral edge of said load bearing surface to support said load bearing surface, said load bearing surface extending to, but not into or beyond said frame attachment openings.

2. The assembly of claim 1 wherein the load bearing surface is a fabric.

3. The assembly of claim 1 wherein said frame includes a plurality of prongs, each of said prongs having a barb, and wherein each of said frame attachment openings is a slot that receives one of said prongs, said prongs having a portion that extends transverse to said frame attachment openings to overlie a portion of said retainer.

4. The assembly of claim 1 wherein said load bearing surface includes a first edge and a second edge opposite said first edge, said second portion of said molded plastic retainer attached to said first edge and said second edge.

5. The assembly of claim 1 wherein said retainer holds said load bearing surface in tension over said frame opening.

6. An injection molded plastic retainer for supporting a load bearing surface on a frame defining an opening, the retainer comprising a first strip attached to the frame, a second strip attached to the load bearing surface, and an elastic connector extending between said first strip and said second strip, said elastic connector integrally molded with said first strip and said second strip, wherein only a portion of said injection molded plastic retainer is oriented on a molecular level such that it includes a crystalline structure having a greater degree of alignment in one direction than in other directions, said oriented portion including said elastic connector, wherein said first strip, said second strip and said elastic connector each have a thickness, said thickness of said elastic connector being less than said thickness of said first strip and said second strip.

7. The molded plastic retainer of claim 6 wherein said elastic connector includes a plurality of said elastic connectors.

8. The molded plastic retainer of claim 7 wherein said elastic connectors are generally parallel.

9. The molded plastic retainer of claim 8 wherein said direction of orientation of said elastic connectors is generally perpendicular to said first strip and said second strip.

10. The molded plastic retainer of claim 9 wherein said elastic connectors are oriented such that their crystalline structures each have about the same degree of alignment.

11. The molded plastic retainer of claim 6 wherein said elastic connector is oriented by compression.

12. A method of manufacturing a load bearing assembly, comprising:

providing a frame that defines an opening;

providing a load bearing surface extending over the opening;

injection molding a plastic retainer such that the retainer includes a first portion, a second portion and a third portion;

attaching the load bearing surface to the molded plastic retainer at the first portion, the load bearing surface not extending into the second portion or third portion of the plastic retainer;

orienting only the second portion of the molded plastic retainer on a molecular level by aligning the crystalline structure of the second portion to a greater degree in one direction than in other directions; and attaching the third portion of the molded plastic retainer to the frame such that the load bearing surface is supported over the opening.

13. The method of claim 12 wherein the step of attaching the edge of the load bearing surface to the first portion of the molded plastic retainer includes molding the retainer to encapsulate a portion of the load bearing surface.

14. The method of claim 12 wherein the step of orienting the second portion of the molded plastic retainer includes stretching the second portion in the direction of orientation.

15. The method of claim 12 wherein the step of orienting the second portion of the molded plastic retainer includes compressing the second portion with a die extending in a direction generally perpendicular to the direction of orientation.

16. The molded plastic retainer of claim 6 wherein the first and second strips have a thickness about equal to one another.

* * * * *